US006797346B2

(12) United States Patent
Kumar

(10) Patent No.: US 6,797,346 B2
(45) Date of Patent: Sep. 28, 2004

(54) DECORATIVE PUMPKIN KIT

(75) Inventor: Sanjeev Kumar, Munster, IN (US)

(73) Assignee: Hosley International Trading Corporation, Lynwood, IL (US)

( * ) Notice: Subject to any disclaimer, the term of this patent is extended or adjusted under 35 U.S.C. 154(b) by 0 days.

(21) Appl. No.: 10/345,563

(22) Filed: Jan. 16, 2003

(65) Prior Publication Data

US 2004/0142120 A1 Jul. 22, 2004

(51) Int. Cl.[7] ..... A41G 1/00

(52) U.S. Cl. ..... 428/7; 428/11; 428/17; 446/69; 446/76; D11/117; D11/121; D11/131.1; D9/307; D26/9; D26/16; D26/19

(58) Field of Search ..... D11/131.1, 117, D11/121; D26/9, 16, 19; D9/310; 428/7, 11, 17; 446/69, 76

(56) References Cited

U.S. PATENT DOCUMENTS 784,888 A * 3/1905 Reisner ..... 446/69

FOREIGN PATENT DOCUMENTS

GB 2160113 * 12/1985

OTHER PUBLICATIONS

Pumpkins on Spider Legs Luminary, www.goantiques.com, 2002.*
Pumpkin Luminary Can, www.majesticwoodcraft.com, no date.*
Halloween Metal Candle Holder, www.joann.com, no date.*
Keepsake Candles, www.keepsakecandles.com, no date.*
www.mrpotatohead.net.*

* cited by examiner

*Primary Examiner*—Terrel Morris
*Assistant Examiner*—A B Sperty
(74) *Attorney, Agent, or Firm*—Olson & Hierl, Ltd.

(57) ABSTRACT

A kit of decorative pumpkins is disclosed where one of the pumpkins incorporates a rear opening large enough to allow the other pumpkins comprising the kit to be introduced therethrough for convenient storage within the one pumpkin. Each of the pumpkins can also incorporate pumpkin shell decorations thereon defined by shell cut-outs which define pliable peripheral edges adapted to be bent for altering the appearance of the shell decoration.

10 Claims, 6 Drawing Sheets

DECORATIVE PUMPKIN KIT

FIELD OF THE INVENTION

This invention relates to decorative pumpkins and, more particularly, to a kit of decorative pumpkins.

BACKGROUND OF THE INVENTION

It is not uncommon for individuals during the halloween season to display several decorative pumpkins of various shapes and sizes. A problem associated with the use and display of decorative pumpkins, as with the use and display of other types of holiday decorations, is that they must all be stored away at the end of the season. This is a problem, of course, in many homes where storage or attic space is limited.

The present invention is directed to a kit of decorative halloween pumpkins where one of the pumpkins serves as a container for the other pumpkins in the kit thus reducing the space needed to store the pumpkins in the off-season.

SUMMARY OF THE INVENTION

The present invention is directed to a decorative pumpkin kit including a plurality of decorative pumpkins where a first pumpkin includes a shell which defines a hollow interior and an access opening in communication with the interior. In accordance with the invention, the opening is sized to receive the other pumpkins comprising the pumpkin kit within the interior of the first pumpkin.

A flap covers the access opening and is hingedly connected to the shell of the first pumpkin above the opening thereof. Another opening is defined in the top of the shell of the first pumpkin and a cylindrical vertical wall defining a collar is in communication with and extends upwardly from this other opening.

The shell of the decorative pumpkins may also be made from a pliable material and incorporate a plurality of cut-outs which together define a pumpkin shell decoration. In accordance with another object of the present invention, the cut-outs define pliable edges which are adapted to be manipulated to alter the appearance of the pumpkin shell decoration. In one embodiment, the shell decoration is in the form of a pumpkin face and the pliable edges are adapted to be manipulated for altering the appearance of the pumpkin face.

DETAILED DESCRIPTION OF THE PREFERRED EMBODIMENT OF THE PRESENT INVENTION

Figure 1:
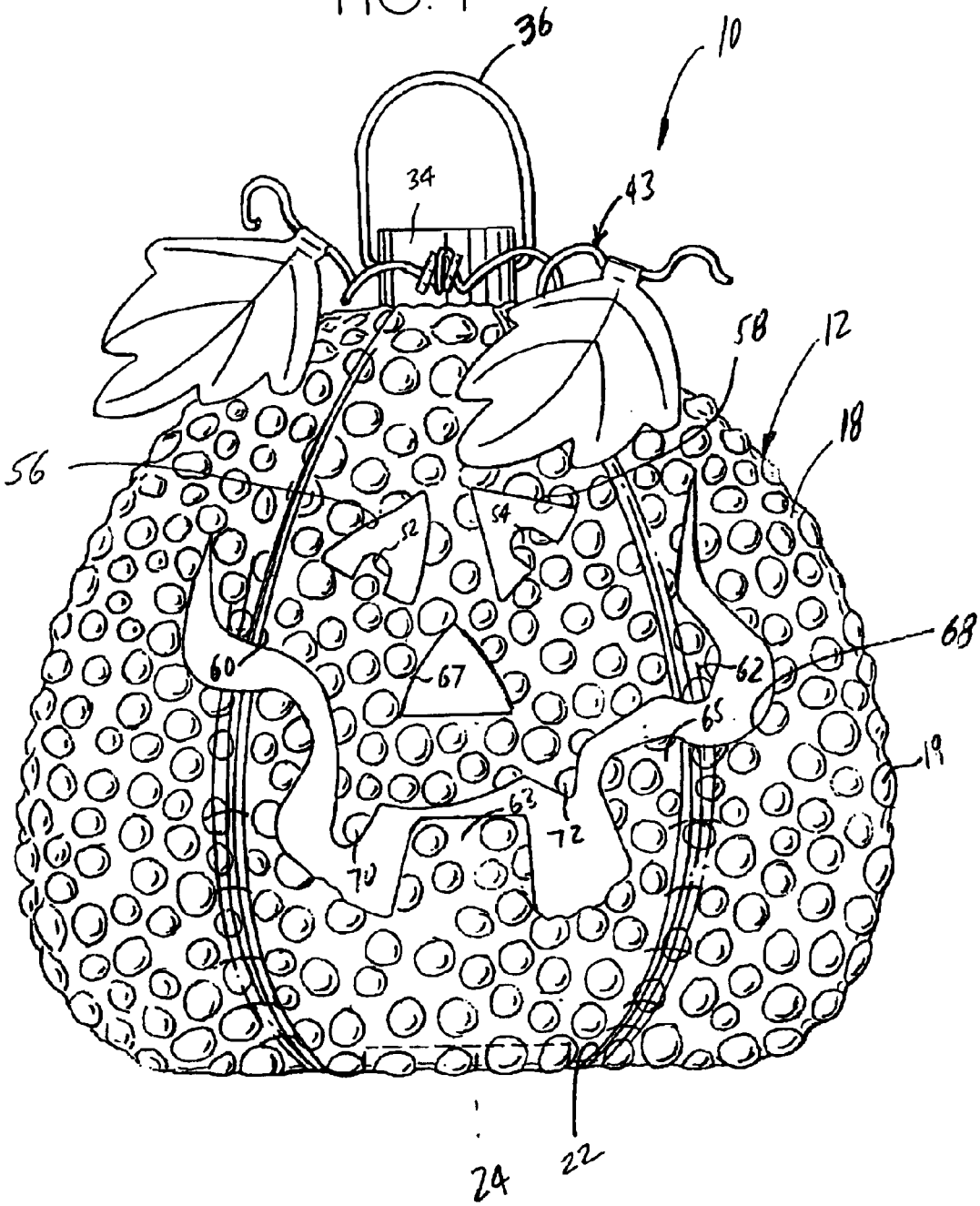
FIG. 1 is a front elevational view of a decorative pumpkin kit in accordance with the present invention.

The invention disclosed herein is, of course, susceptible of embodiment in many different forms. Shown in the drawings and described herein below in detail is a preferred embodiment of the decorative halloween pumpkin kit of the present invention. It is to be understood, however, that the present disclosure is an exemplification of the principles of the invention and does not limit the invention to the illustrated embodiment.

For ease of description, the decorative halloween pumpkin kit of the present invention is described herein below in its usual vertical position sitting on a horizontal support surface and terms such as upper, lower, vertical, etc., will be used herein with reference to this usual position.

Moreover, it is understood that the FIGURES herein do not necessarily show details of the decorative halloween pumpkin kit that are known in the art and that will be recognized by those skilled in the art as such. The detailed descriptions of such elements are not necessary to an understanding of the invention. Accordingly, such elements are herein represented only to the degree necessary to aid in an understanding of the features of the present invention.

Figure 2:
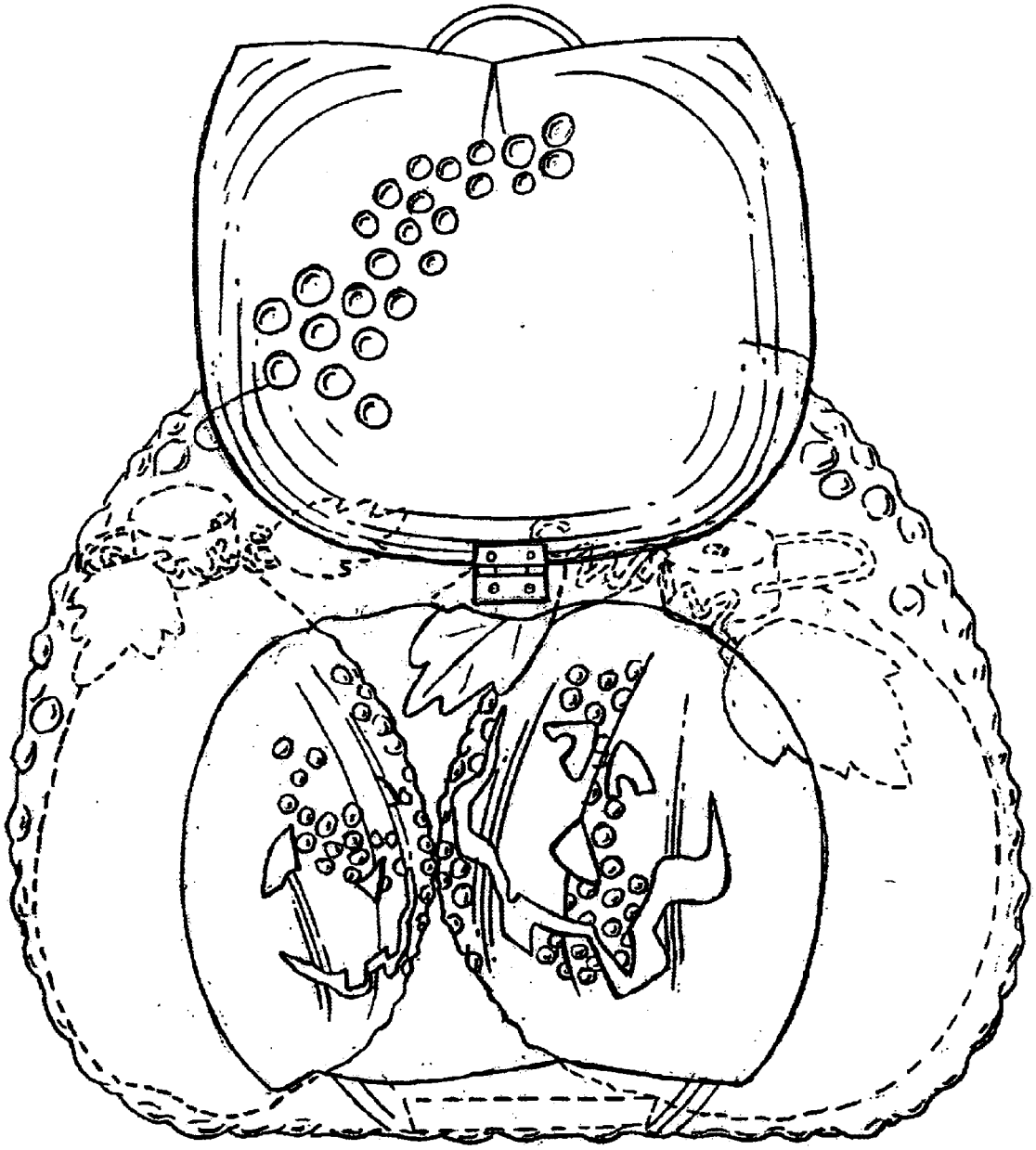
FIG. 2 is a rear elevational view of the decorative pumpkin of FIG. 1 with the flap thereon in its open position and depicting the smaller decorative pumpkins in the interior thereof together comprising the decorative pumpkin kit of the present invention.
Figure 3:
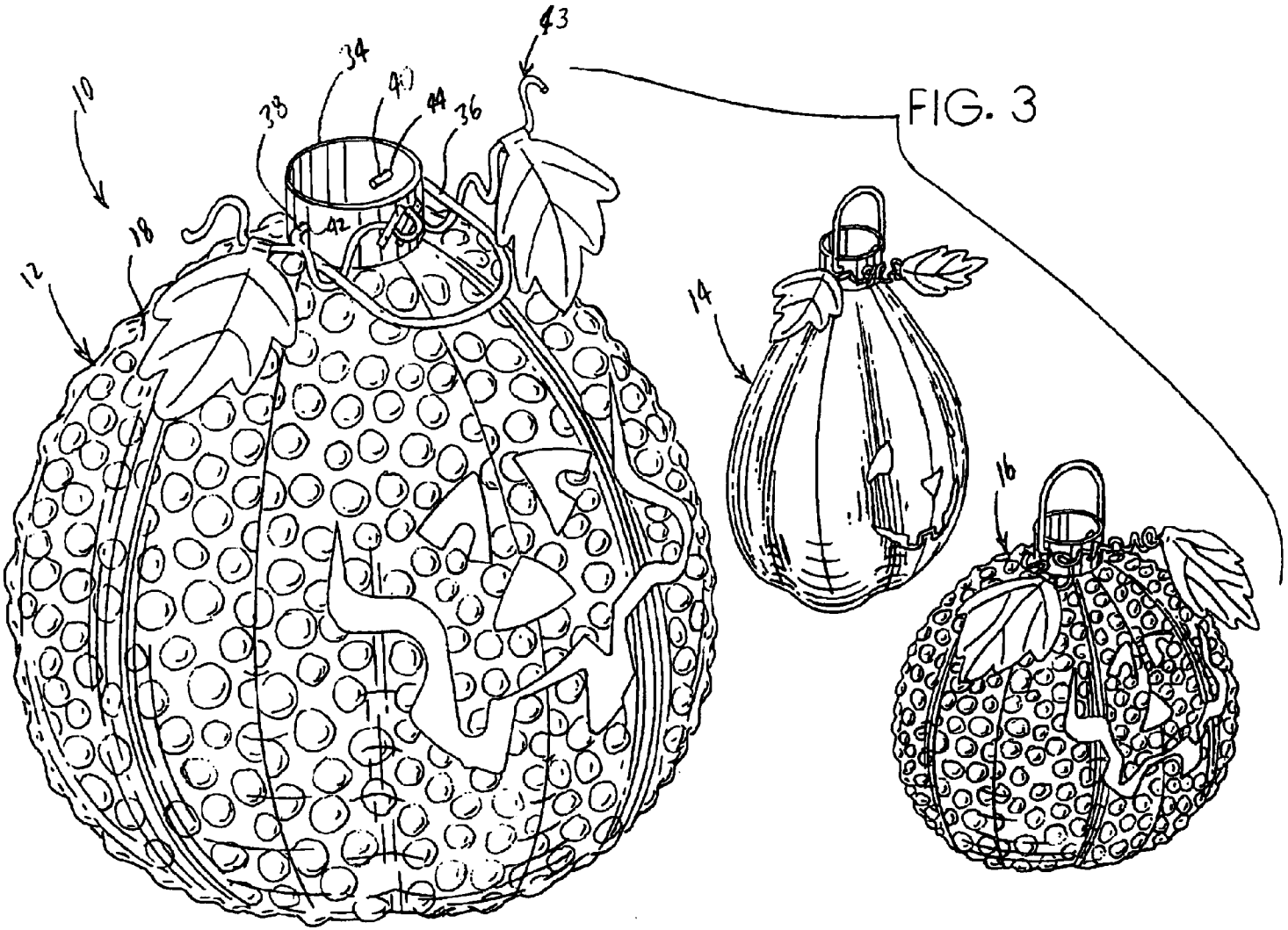
FIG. 3 is a perspective view depicting each of the decorative pumpkins comprising the decorative pumpkin kit of the present invention.

FIGS. 1–3 depict the decorative halloween pumpkin kit 10 constructed in accordance with the features of the present invention. Specifically, the decorative pumpkin kit 10 comprises a plurality of varyingly sized and shaped decorative pumpkins 12, 14 and 16 where the decorative pumpkin 12 is the largest of the three pumpkins and is sized to receive and store within the interior thereof the two smaller decorative pumpkins 14 and 16 in the manner described in more detail below.

The pumpkin 12 includes a body or shell 18 which, in the embodiment shown, is made of a thin layer of metal or the like pliable material whose surface includes a plurality of surface bumps or bubbles 19 (FIG. 1). The pumpkins 14 and 16 (FIG. 3) are also constructed from similar pliable materials. The pumpkin 16 is similar in shape and structure to the pumpkin 12 except that the pumpkin 16 is smaller in size than the pumpkin 12. The pumpkin 14 is similar in size to the pumpkin 16 but has a more elongated shell with a smooth surface.

Figure 4:
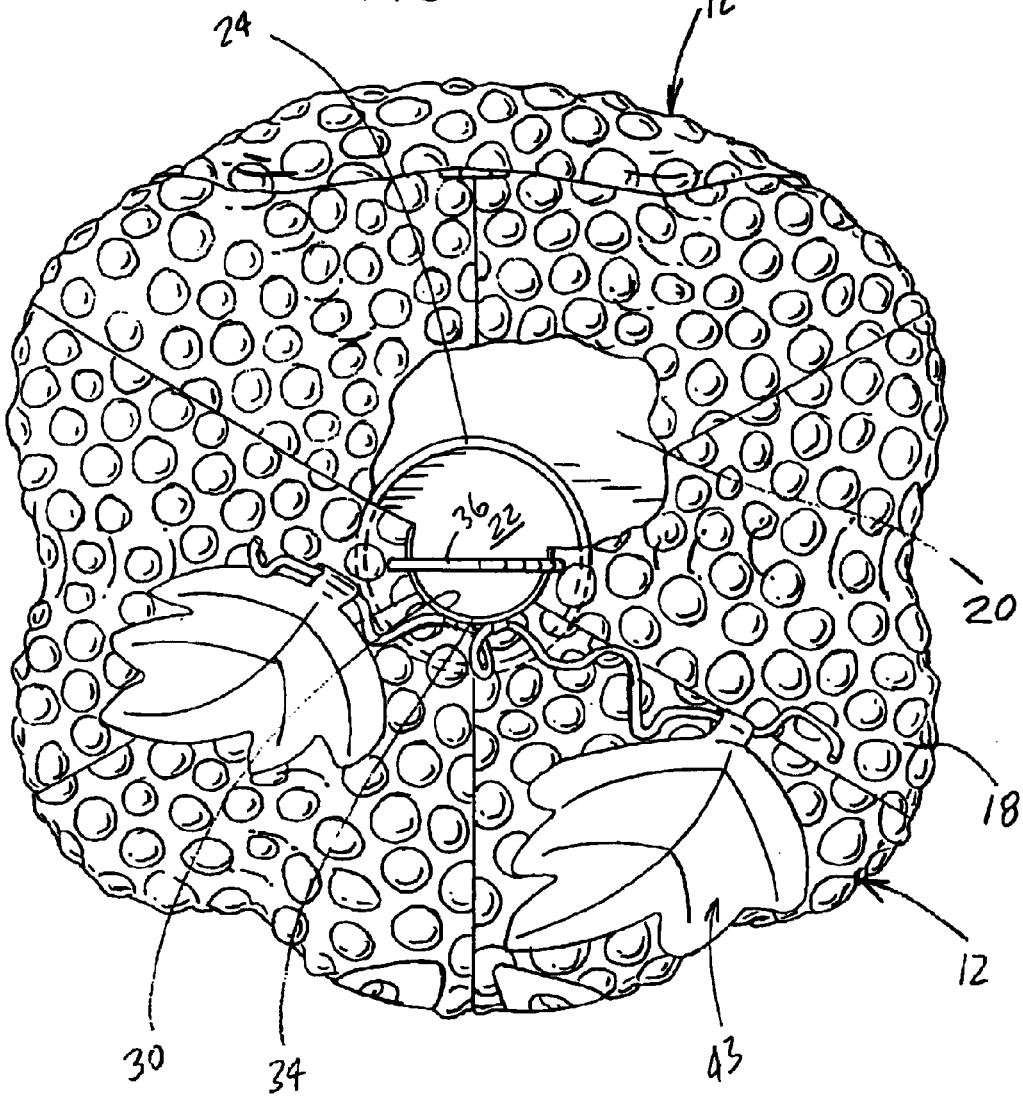
FIG. 4 is a partially broken top plan view of the decorative pumpkin of FIG. 1.

As shown in FIGS. 2 and 4, the shell 18 of the pumpkin 12 defines a hollow interior 20 and a bottom interior shell surface 22 with a ring 24 formed thereon and adapted to receive and seat a votive candle (not shown).

A large opening 28 (FIG. 2) is defined in the back or rear of the surface of the shell 18 and a smaller circular shaped opening 30 (FIG. 4) is defined in the top of the shell 18. Both openings 28 and 30 are respectively in communication with the interior 20 of the shell 18.

The opening 28 is covered by an access flap or door 32 which is hingedly connected above the opening 28 to the back of the shell 18. A cylindrical vertically extending wall defining a collar 34 extends unitarily upwardly from the top surface of the shell 18 directly over and surrounding the circumferentially extending peripheral edge of the top opening 30. In the embodiment where a candle is seated in the interior of the pumpkin 12, the opening 28 and collar 34 define an exhaust for the smoke and heat created by the candle. A curved handle 36 is attached to, and extends upwardly from, the collar 34. Particularly, the handle 36 includes a pair of opposed inwardly bent ends 38 and 40 (FIG. 3) which extend through respective diametrically opposed openings 42 and 44 formed in opposed sides of the wall which forms the collar 34. A vine and leaf decoration 43 adorns and is attached to the front of the collar 34. The smaller pumpkins 14 and 16 incorporate similar top openings, collars, handles and vine and leaf decorations respectively.

In accordance with the present invention, the back access opening 28 is sized large enough to allow the smaller pumpkins 14 and 16 to be inserted therethrough and into the interior 20 of the pumpkin 12 as shown in FIG. 2 thus providing for the compact and efficient storage of the pumpkins 12, 14 and 16 comprising the kit 10 at the end of the display season.

Figure 6:
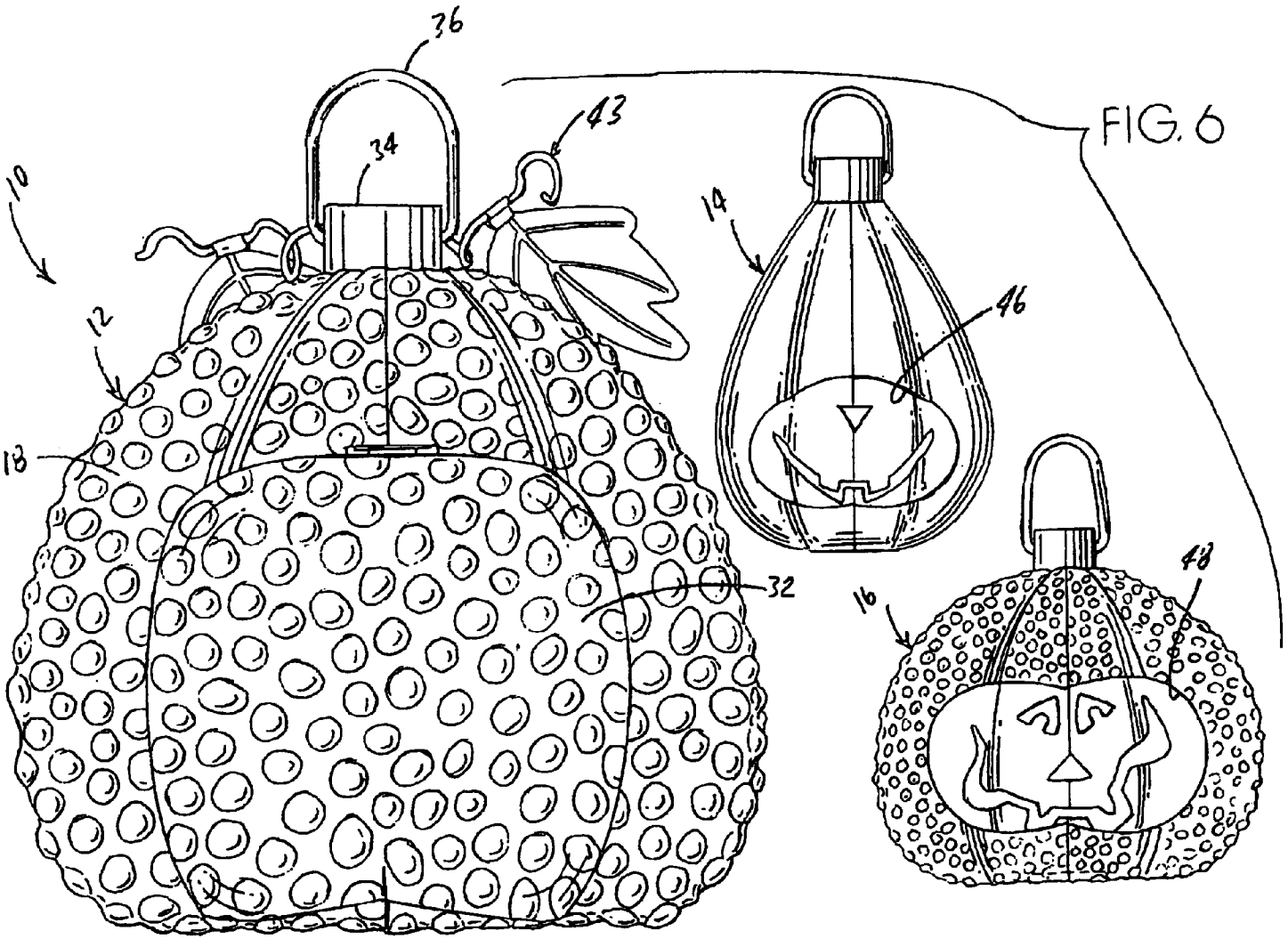
FIG. 6 is a rear elevational view depicting the rear openings of each of the decorative pumpkins comprising the kit of the present invention.

As shown in FIG. 6, the smaller pumpkins 14 and 16 likewise include respective rear apertures defining respective flapless openings 46 and 48 which, like the opening 28 in the rear of the pumpkin 12, can be used to introduce even smaller decorative pumpkins, candles or the like articles within the respective interiors thereof.

Figure 5:
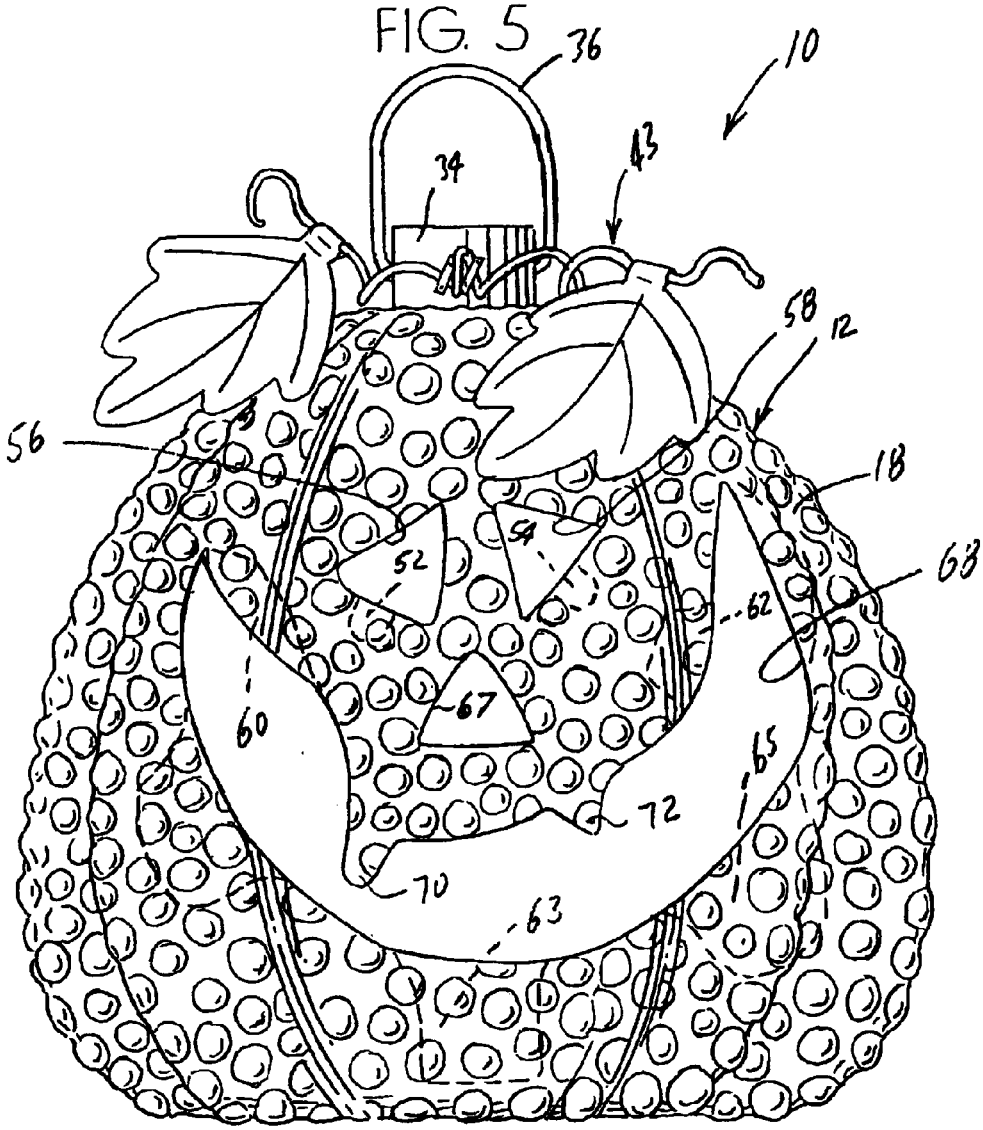
FIG. 5 is a front elevational view of the decorative pumpkin of FIG. 1 with certain of the pliable edges of the face cut-outs bent inwardly to create a different facial expression than that shown in FIG. 1.

In accordance with another feature of the present invention, the pumpkin 12 also comprises a plurality of varyingly sized and shaped cut-outs formed in the surface of the shell 18 which, in the embodiment shown, define the eyes, nose, and mouth of a decorative pumpkin face. The cut-outs, by virtue of the pliable nature of the metal or the like material comprising the shell 18, define surrounding pliable cut-out edges or projections adapted to be manipulated by a user to alter or modify the appearance or look of the features of the decorative pumpkin shell face. FIGS. 1 and 5 in combination illustrate the ways in which the expression of the decorative pumpkin face can be altered. For example, the two pliable edges or projections 52 and 54 of the respective cut-outs 56 and 58 defining the eyes of the decorative pumpkin 12 shown in FIG. 1 can be bent inwardly and downwardly into the interior of the pumpkin 12 as shown in FIG. 5 to change the appearance or look of the eyes. Four other of the edges or projections 60, 62, 63 and 65 of the elongate cut-out 68 defining the mouth of the decorative pumpkin 12 shown in FIG. 1 have also been bent inwardly and downwardly into the interior of the pumpkin 12 to modify the appearance of the mouth of the decorative pumpkin as shown in FIG. 5. A triangularly shaped cut-out 67 defines the nose of the pumpkin face.

It will be readily apparent from the foregoing detailed description of the invention and from the illustrations thereof that numerous variations and modifications may be effected to the decorative pumpkin kit of the present invention without departing from the true spirit and scope of the novel concepts or principles of this invention. For example, it is understood that FIG. 5 is but one example of the appearance which can be achieved by bending certain of the edges of the pliable cut-outs of the pumpkin embodiment of FIG. 1 and that other of the edges of the pumpkin embodiment of FIG. 1 such as, for example, edges 70 and 72 defined in the mouth 68, can be bent to achieve yet additional different decorative appearances. It is also understood that the face on the pumpkin 12 is but one example of the various decorations which can be adapted to adorn the surface thereof. Although not shown, it is further understood that the smaller pumpkins 14 and 16 may incorporate like decorative cut-outs defining like pliable and bendable surrounding peripheral edges.

I claim:

1. A decorative pumpkin kit comprising a plurality of decorative pumpkins where a first pumpkin includes a shell defining a hollow interior and an access opening in communication with the interior, the interior of the first pumpkin and the opening therein being sized to receive the other pumpkins comprising the pumpkin kit within the interior of the first pumpkin in a non-nesting, side-by-side relationship, wherein the shell of the first pumpkin includes a bottom interior surface having a ring sized to receive a votive candle therein.

2. The decorative pumpkin kit of claim 1 wherein a flap covers the access opening.

3. The decorative pumpkin kit of claim 2 wherein the flap is hingedly connected to the shell of the first pumpkin above the opening thereof.

4. The decorative pumpkin kit of claim 1 wherein another opening is defined in the top of the shell of the first pumpkin.

5. The decorative pumpkin kit of claim 4 wherein a cylindrical vertical wall defines a collar in communication with and extending upwardly from the other opening.

6. The decorative pumpkin kit of claim 1 wherein each of the pumpkins comprising the pumpkin kit includes a shell composed of a pliable material and defining an interior, the shell having cut-outs formed therein defining a pumpkin shell decoration, each of the cut-outs defining a plurality of shell edges which by virtue of the pliable material of the shell are manipulable and bendable to alter the shape and appearance of the shell decoration.

7. A decorative pumpkin comprising a shell made of a pliable material and having a plurality of cut-outs formed therein and together defining a pumpkin shell decoration, the cut-outs defining edges which by virtue of the pliable shell material can be manipulated and bent for altering the appearance of the pumpkin shell decoration, wherein the shell includes a bottom interior surface having a ring sized to receive a votive candle therein.

8. The decorative pumpkin of claim 7 wherein the pumpkin shell decoration is in the form of a pumpkin face and the pliable edges can be manipulated and bent into the interior of the pumpkin for altering the appearance of the pumpkin face.

9. The decorative pumpkin of claim 7 wherein the shell defines an interior and an opening in communication with the interior through which articles are inserted into the interior of the pumpkin.

10. The decorative pumpkin of claim 9 wherein a flap covers the opening.

* * * * *